US006257753B1

(12) United States Patent
King et al.

(10) Patent No.: US 6,257,753 B1
(45) Date of Patent: Jul. 10, 2001

(54) METHOD OF MIXING VISCOUS FLUIDS

(76) Inventors: David Marshall King, 1044 W. Hartley, Ridgecrest, CA (US) 93555; Ronnald Brian King, 3405 S. Manito Blvd., Spokane, WA (US) 99203; Thomas Arnold Martin, 228 E. Hartley, Ridgecrest, CA (US) 93555

( * ) Notice: Subject to any disclaimer, the term of this patent is extended or adjusted under 35 U.S.C. 154(b) by 0 days.

(21) Appl. No.: 09/686,144

(22) Filed: Oct. 10, 2000

Related U.S. Application Data

(62) Continuation of application No. 09/556,594, filed on Apr. 21, 2000, now Pat. No. 6,193,405, which is a continuation of application No. 09/091,145, filed as application No. PCT/US96/19345 on Dec. 5, 1996, now Pat. No. 6,062,721.

(51) Int. Cl.[7] ..... B01F 5/12; B01F 7/32

(52) U.S. Cl. ..... 366/129; 366/265; 366/317; 366/605

(58) Field of Search ..... 366/129, 130, 366/262, 263, 265, 270, 315–317, 342, 343, 348, 605; 416/178, 184, 187

(56) References Cited

U.S. PATENT DOCUMENTS

| | | |
|---|---|---|
| 59,493 | 11/1866 | Willcox . |
| 1,067,007 | 7/1913 | Douglas . |
| 1,084,210 | 1/1914 | Howard . |
| 1,765,386 | 6/1930 | Wait . |
| 1,908,002 | 5/1933 | Valentine . |
| 2,226,470 | 12/1940 | McGuffee . |
| 2,230,146 | 1/1941 | Myers . |
| 2,520,540 | 8/1950 | Green . |
| 2,724,547 | 11/1955 | Abbott et al. . |
| 2,803,398 | 8/1957 | Sprouse . |
| 2,879,044 | 3/1959 | Gunas . |
| 3,166,303 | 1/1965 | Chapman . |
| 3,319,940 | 5/1967 | Mentnech . |
| 3,362,689 | 1/1968 | Rothman et al. . |
| 3,423,075 | 1/1969 | Knudsen et al. . |
| 3,464,622 | 9/1969 | Dennis . |
| 3,521,973 | 7/1970 | Schouw . |
| 3,690,621 | 9/1972 | Tanaka . |
| 3,733,645 | 5/1973 | Seiler . |
| 3,846,043 | 11/1974 | Wolbrink et al. . |
| 3,972,512 | 8/1976 | Grise et al. . |
| 4,175,875 | 11/1979 | Van Horbek . |
| 4,472,063 | 9/1984 | Eickelmann . |
| 4,483,624 | 11/1984 | Bacon, Jr. et al. . |
| 4,538,922 | 9/1985 | Johnson . |
| 4,738,593 | 4/1988 | Reifschneider . |
| 4,893,941 | 1/1990 | Wayte . |
| 4,900,159 | 2/1990 | Jamison . |
| 4,948,262 | 8/1990 | Tome, Jr. . |
| 5,073,033 | 12/1991 | Klepeis . |
| 5,251,979 | 10/1993 | Larsen . |
| 5,314,310 | 5/1994 | Bachellier . |
| 5,417,493 | 5/1995 | Ericson . |
| 5,865,539 | 2/1999 | Rogers . |
| 5,984,518 | 11/1999 | King et al. . |
| 5,988,979 | 11/1999 | Wang . |
| 6,062,721 | 5/2000 | King et al. . |
| 6,068,395 | 5/2000 | Ondracek . |

FOREIGN PATENT DOCUMENTS

| | | |
|---|---|---|
| 2225800 | 7/1980 | (DE) . |
| 1064111 | 4/1967 | (GB) . |
| WO 97/20623 | 6/1997 | (WO) . |

*Primary Examiner*—Charles E. Cooley
(74) *Attorney, Agent, or Firm*—Weide & Assoc., Ltd.

(57) ABSTRACT

A method of mixing viscous fluids is disclosed. The method comprises rotating a mixing apparatus (20) in a container (42) of fluid (44). The mixing apparatus comprises a cage (21) located at the end of a shaft (22). The cage (21) comprises a central circular disc (24) with an outer edge (43) and top (38) and bottom (40) sides. A number of vanes (26) extend from each side of the disc (24), the vanes (26) spacedly located near the outer edge of the plate. The free ends of the vanes (26) are connected by a hoop (38, 40) to maintain their spaced relationship.

30 Claims, 3 Drawing Sheets

METHOD OF MIXING VISCOUS FLUIDS

RELATED APPLICATIONS

This application is a continuation of U.S. application Ser. No. 09/556,594, filed Apr. 21, 2000 now U.S. Pat. No. 6,193,405, which is a continuation of U.S. application Ser. No. 09/091,145, filed Apr. 16, 1999. now U.S. Pat. No. 6,062,721, which claims the benefit of International Application No. PCT/US96/19345, filed Dec. 5, 1996, which claims the benefit of U.S. application Ser. No. 08/567,217, filed Dec. 5, 1995, now abandoned.

FIELD OF THE INVENTION

The present invention relates to a method of mixing fluids. More particularly, the present invention is a method of mixing viscous fluids by rotating a multi-vaned mixer.

BACKGROUND OF THE INVENTION

The mixing of viscous fluids has historically been a difficult task. Present methods of mixing such fluids often result in inadequate mixing and are time-consuming and energy consumptive.

One of the more common viscous fluids which must be mixed is paint. Homeowners and painters are all too familiar with the task of mixing paint.

Probably the most common method of mixing fluid such as paint involves the user opening the container, inserting a stir stick or rod and rotating or moving the stick about the container. This method is tiring, requiring tremendous effort to move the stir stick through the viscous fluid. Because of this, individuals often give up and stop mixing long before the paint is adequately mixed. Further, even if the individual moves the stir stick for a long period of time, there is no guarantee that the paint is thoroughly mixed, rather than simply moved about the container.

Many mechanisms have been proposed for mixing these fluids and reducing the manual labor associated with the same. These mechanisms have all suffered from at least one of several drawbacks: users have difficulty in using the device because of its complexity or size, the device inadequately mixes the fluid, the device mixes too slowly, the device does not break up or "disperse" clumped semi-solids in the fluid, and/or the user has a difficult time cleaning up the device after using it. Other problems associated with these mixers are that they often introduce air into the fluid (which, in the case of paint is detrimental, for example, when the paint is to be sprayed with a sprayer), and some of the mixing devices may damage the container in which the fluid is being mixed, causing the fluid to leak from the container.

One example of such a mechanized mixing device is essentially a "screw" or auger type device. An example of such a device is illustrated in U.S. Pat. No. 4,538,922 to Johnson. This device is not particularly effective in mixing such fluids, as it imparts little velocity to the fluid. Further, the device does not disperse clumped fluid material, but simple pushes it around the container.

Another method for mixing paint comprises shaking the paint in a closed container. This can be done by hand, or by expensive motor-driven shakers. In either instance, the mixing is time consuming and often not complete. Because the shaking occurs with the container closed, little air space is often available for the fluid therein to move about. Therefore, the shaking often tends to move the fluid very little within the container.

Several devices have been developed for mixing paint which comprise devices for connection to drills. For example, U.S. Pat. No. 4,893,941 to Wayte discloses a mixing device which comprises a circular disc having vanes connected thereto. The apparatus is rotated by connecting a drill to a shaft which is connected to the disc. This device suffers from several drawbacks. First, the limited number of vanes does not provide for thorough mixing. Second, because the bottom disc is solid, no fluid is drawn through the device from the bottom. It is often critical that fluid from the bottom of the container be drawn upwardly when mixing viscous fluids, since this is where the heaviest of the fluids separate prior to mixing.

U.S. Pat. No. 3,733,645 to Seiler discloses a paint mixing and roller mounting apparatus comprising a star-shaped attachment. This apparatus is not effective in mixing paint, as it does not draw the fluid from the top and bottom of the container. Instead, the paddle-like construction of the device simply causes the fluid to be circulated around the device.

U.S. Pat. No. 1,765,386 to Wait discloses yet another device for mixing liquids. This device is wholly unacceptable, as it must be used in conjunction with a diverter plate located in the container to achieve adequate mixing. Use of the diverter plate would either require its installation into a paint container before being filled, which would increase the cost of paint to the consumer, or require that the consumer somehow install the device into a full paint container.

An inexpensive method for mixing viscous fluids in a quick and effective manner is needed.

SUMMARY OF THE INVENTION

The present invention is a method of mixing viscous fluids. The method comprises locating a mixing device in a container of fluid and rotating said device in said fluid with rotary drive means. The mixing device preferably comprises a mixing cage connected to a shaft.

The shaft is elongate, having a first end connected to a central plate and a second free end for connection to the rotary drive means. The plate is solid, circular, and has a top side, bottom side, and outer edge.

Vanes in the form of thin, curved slats, are spacedly positioned about the outer edge of each side of the plate. The vanes extend outwardly from each side of the plate parallel to the shaft. A first end of each vane is connected to the plate near the outer edge thereof. The vanes are connected at their second ends by a hoop.

The vanes preferably have a length which is between about 0.1–2 times the diameter of the plate. The number of vanes located about each side of the plate preferably number between 4 and 12 per inch diameter of the plate. Each van preferably extends inwardly from the periphery of the plate not more than about 0.1–0.35 of the distance from the center of the plate to the periphery thereof at that location.

In use, a user positions the mixing cage of the device in a container of fluid. The user connects the free end of the shaft to the rotary drive means, such as a drill, and rotates the cage within the fluid.

The device has been found to be extremely effective in mixing viscous fluids such as paint. The device draws fluid, without the need of a diverter plate, from the top and bottom of the container. This fluid is dispersed at high velocity radially outwardly through the vanes.

The device is easy to use, as a user need only connect it to a drill. The device is easy to clean, the user needing only to relocate it and rotate it in a container of cleaning fluid.

Further objects, features, and advantages of the present invention over the prior art will become apparent from the detailed description of the drawings which follows, when considered with the attached figures.

DETAILED DESCRIPTION OF THE PREFERRED EMBODIMENT

The present invention comprises a method of thoroughly mixing a fluid with a mixing device. In general, the method comprises rotating the mixing device in a container containing the fluid. As used herein, the term "fluid" is intended to mean liquids, especially those of a viscous nature whether containing dissolved or undissolved solids, slurries, gels and those groupings of solid or semi-solid materials which behave in some respects as a fluid, such as granular materials (e.g. flour, sugar, sand etc.).

Figure 1:
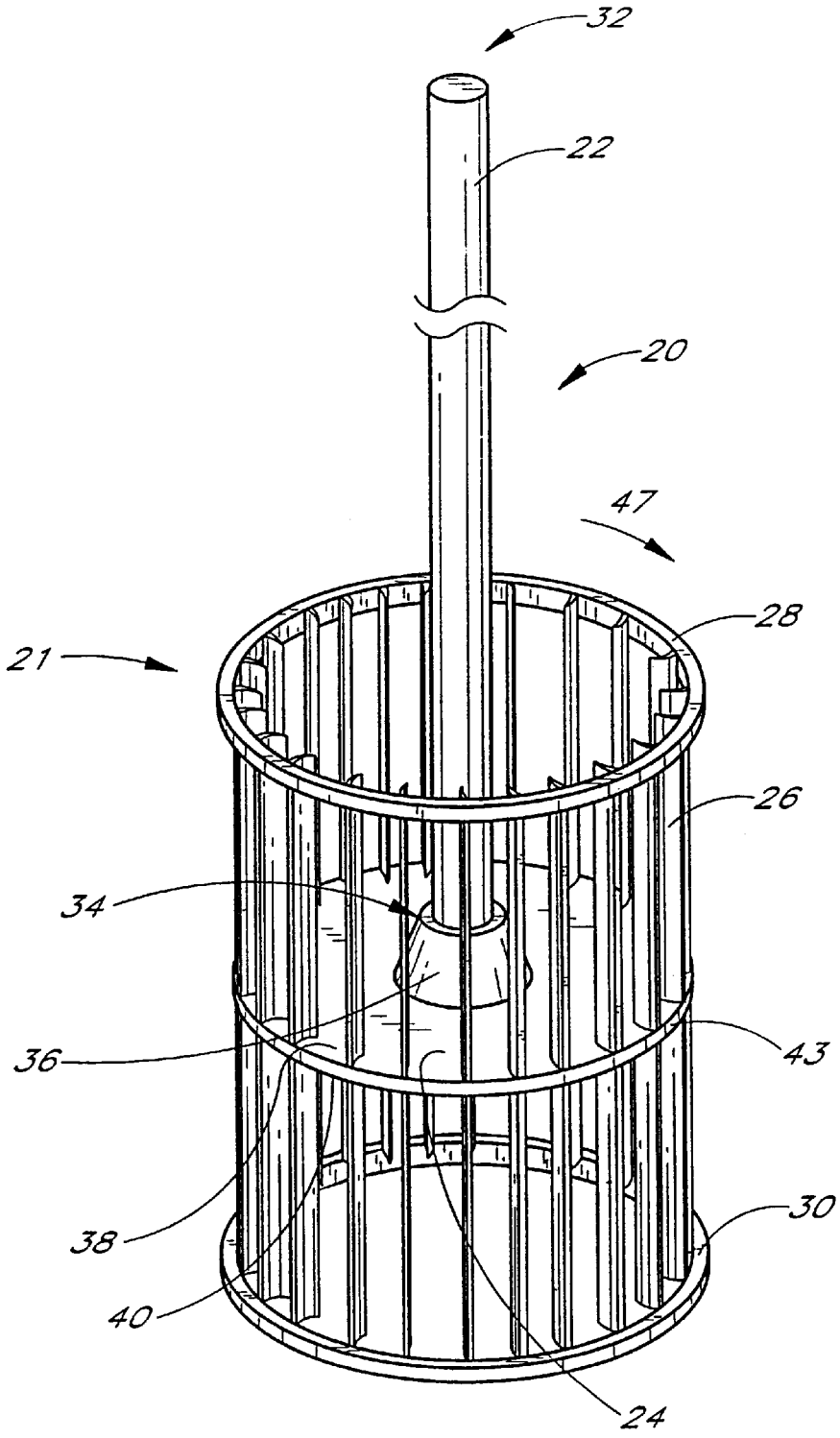
FIG. 1 is a perspective view of a mixing device for use in the method of the present invention.
Figure 5:
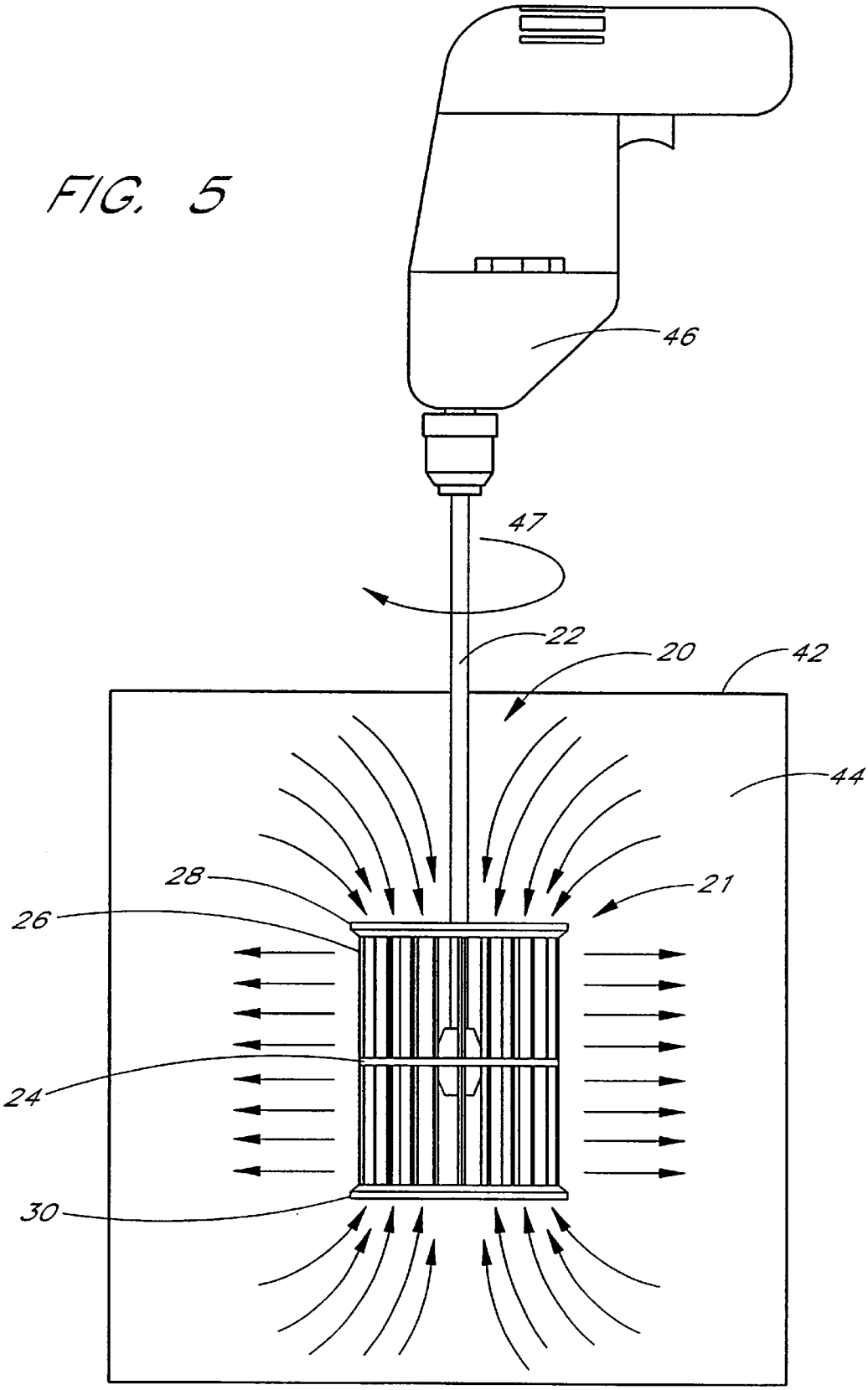
FIG. 5 illustrates use of the mixing device of FIG. 1 to mix a fluid in a container.

As illustrated in FIG. 1, the mixing device 20 generally comprises a cage-like structure having open ends. As illustrated in FIG. 5, the device 20 includes a shaft 22 for rotation by rotary drive means such as a drill 46, the shaft connected to a central connecting plate 24. Vanes 26 extend outwardly from each side of the central connecting plate 24 parallel to the shaft 22. The vanes 26 are connected at their ends opposite the plate by a hoop 28,30.

In use, a user positions the mixing device in a container 42 of fluid 44. The user connects the shaft 22 of the device 20 to a drill 46 and rotates it within the fluid. As illustrated in FIG. 5, the mixing device 20 mixes the fluid by drawing it from the top and bottom of the container 42 and forcing it radially outward through the vanes 26.

The mixing device 20 for use in the present invention will now be described with more particularity with reference to FIGS. 1–5. In general, and as illustrated in FIG. 1, the device 20 includes mixing cage 21 connected to a shaft 22, the mixing cage 21 comprising a central connecting plate 24, vanes 26, and two hoops 28,30.

The shaft 22 is an elongate rigid member having a first end 32 and second end 34. The exact length and diameter of the shaft 22 depends on the depth of the fluid in the container to be mixed. When the device 20 is for use in mixing paint in a standard one-gallon paint can, the shaft 22 can be about 8–9 inches long and about 0.25 inches in diameter.

The first end 32 of the shaft 22 is adapted for connection to a rotary drive means. Preferably, the rotary drive means comprises a drill, as illustrated in FIG. 5. Preferably, the shaft diameter is chosen so that engagement with the rotary drive means is facilitated.

The second end 34 of the shaft 22 is connected to said central plate 24. Preferably, the second end 34 of the shaft 22 engages an adapter 36 connected to the plate 24. The shaft end 34 engages the plate 24 at the center point of the plate 24.

The central plate 24 comprises a flat, disc-shaped member having a top surface 38, bottom surface 40 and outer edge 43. The shaft 22 engages the plate 24 at the top surface 38 thereof.

Preferably, the plate 24 is constructed of durable and fairly rigid material. The plate 24 may be of any of a variety of sizes. When used for batch mixing of quantities of one gallon of highly viscous (i.e. resists flow) liquids such as paint, it is preferably about 1–14, and most preferably about 2.5 inches in diameter.

A number of vanes 26 extend from the top and bottom surface 38,40 respectively, of the plate 24 near the outer edge 43 or periphery thereof. Each vane 26 has a first edge and a second edge, being curved therebetween. The curved shape of the vane 26 causes the vane to have a concave surface 27 and a convex surface 29 (see FIGS. 2 and 4). All of the vanes 26 are oriented on the plate 24 in the same direction. The vanes 26 are oriented on the plate 24 in a manner such that they face in the direction of rotation indicated by arrow 47 in FIGS. 1, 2, 4, and 5, when rotated by the rotational drive means 46.

The vanes 26 are preferably constructed of durable and fairly rigid material. It has been found preferable that the ratio of the length of the vanes 26 to the diameter of the plate be between about 0.1 and 2, and most preferably between 0.2 and 0.7. Moreover, it has been found preferable that the number of vanes 26 be dependent on the ratio of the diameter of the plate 24 on the order of about 4–12, and most preferably about 9 vanes per inch diameter of the plate 24. The width of each vane 26 is preferably no more than 0.1 to 0.35 times the radius of the plate 24, and more preferably about 0.1–0.3, and most preferably about 0.25 times the radius of the plate 24. The thickness of each vane 26 depends on the material from which it is made. Regardless of its width, each vane 26 is preferably positioned at the outer edge 43 of the plate 24 such that the vane 26 extends inwardly therefrom no more that about 0.1–0.35, more preferably less than about 0.3, and most preferably less than about 0.25, of the distance from the center of the plate 24 to the periphery thereof at that vane 26 location (i.e. less than about 0.35 the radius when the plate 24 is circular).

Where the device 20 is configured for use in mixing paint in a one-gallon container and the plate 24 diameter is about 2.5 inches, the vanes 26 are preferably about 1 inch long from their ends at the connection to the plate 24 to their ends connected at the hoops 28,30. Each vane 26 is preferably about 0.2–1, and most preferably about 0.3 inches wide.

Figure 2:
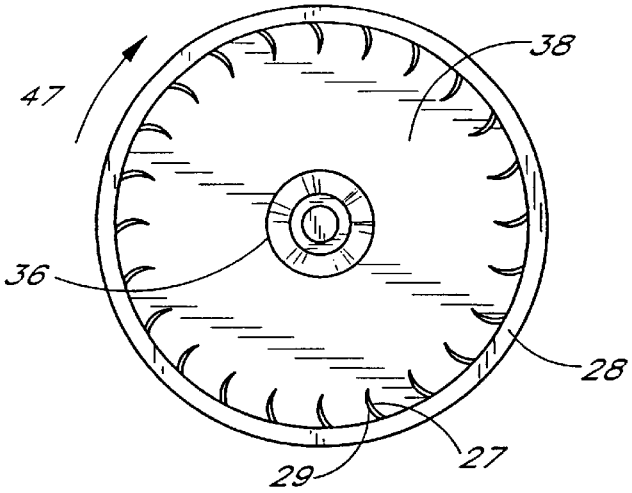
FIG. 2 is a top view of the mixing device of FIG. 1.
Figure 4:
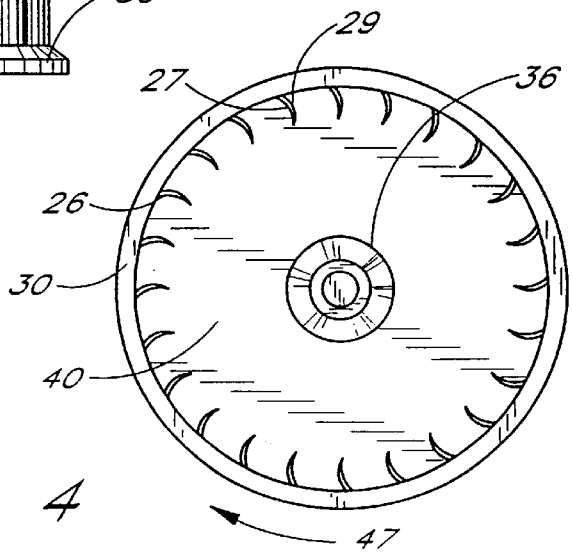
FIG. 4 is a bottom view of the mixing device of FIG. 1.

In order to disperse partially solidified particulate in the fluid, the vanes 26 are fairly closely spaced about the outer edge 43 of the plate 24. The vanes 26 are preferably spaced about 0.1–1 inch, and most preferably about 0.25 inches apart. When the vanes 26 are spaced far apart (e.g. about 1 inch) the vane width and/or height is preferably increased within the above-stated range or ratios. Thus, in the case where the plate 24 has a diameter of about 2.5 inches, there are preferably about twenty-four vanes 26, as illustrated in FIGS. 1, 2, and 4.

Figure 3:
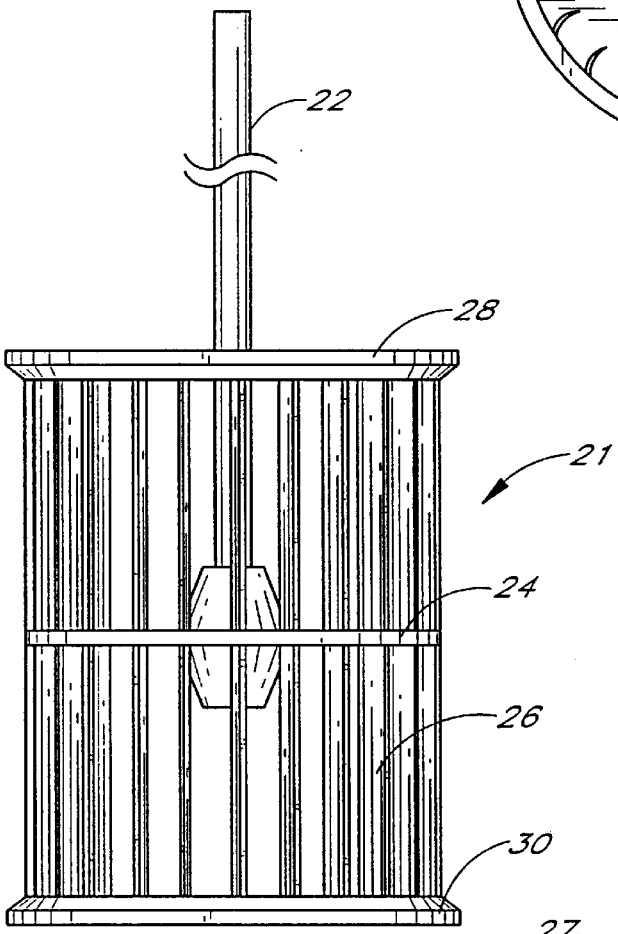
FIG. 3 is a side view of the mixing device of FIG. 1.

In order to prevent relative movement between the free ends of the vane 26, this end of each vane is connected to a support hoop 28,30. The hoop 28,30 comprises a relatively rigid circular member of "L"-shape cross-section. A first portion of each hoop 28,30 extends over the end of each of the vanes, and a second portion of each hoop 28,30 extends downwardly along the outer surface of each vane, as illustrated in FIGS. 2–4. Each vane 26 is securely connected to its corresponding hoop 28,30.

Use of the device 20 described above in the method of the present invention will now be described with reference to FIG. 5.

A user obtains a container 42 containing fluid 44 to be mixed. This container 42 may comprise a paint can or any other container. The fluid 44 to be mixed may comprise nearly any type of fluid, but the method of the present invention is particularly useful in mixing viscous fluids.

The user attaches the device 20 of the present invention to rotary drive means. As illustrated in FIG. 5, the preferred means comprises a drill 46. The means may comprise other apparatus other than a drill, however, such as pulley or gas motor driven means. These drive means preferably turn the shaft 22 of the device at speed dependent upon the viscosity of the fluid. For example, for low viscosity fluids, the rotational speed may be often as low as about 500 rpm, while for high viscosity fluids the rotational speed may often be as high as 1,500 rpm or more. The user attaches the first end 32 of the shaft 22 to the drill 46, such as by locating the end 32 of the shaft in the chuck of the drill.

Once connected, the user lowers the mixing cage 21 into the fluid 44 in the container 42. The user locates the mixing cage 21 below the top surface of the fluid.

Once inserted into the fluid 44, the drill 46 is turned on, thus effectuating rotational movement of the mixing cage 21. While the cage 21 is turning, the user may raise and lower it with respect to the top surface of the fluid and the bottom of the container, as well as move it from the center to about the outer edges of the container, so as to accelerate the mixing of the fluid therein.

Advantageously, and as illustrated in FIG. 5, the device 20 of the present invention efficiently moves and mixes all of the fluid 44 in the container 42. In particular, because of the location of vanes extending from and separated by the central plate 24, the mixing cage 21 has the effect of drawing fluid downwardly from above the location of the cage 21, and upwardly from below the cage, and then discharging the fluid radially outwardly (as illustrated by the arrows in FIG. 5). This mixing effect is accomplished without the need for a diverter plate in the bottom of the container.

Most importantly, partially solid particulate in the fluid is effectively strained or dispersed by the vanes 26 of the cage 21. The close spacing of the vanes 26 traps unacceptably large undeformable globules of fluid or other solid or partially solid material in the cage, for removal from the cage after mixing. Other globules of partially solidified fluid material are sheared apart and dispersed when they hit the vanes, reducing their size and integrating them with the remaining fluid.

Advantageously, optimum mixing is achieved with the present device 20 as a result of the positioning of substantially long inner and outer van edges at the periphery of the plate 24. This allows the fluid moving through the device 20 to impact upon the inner edge of the vane 26 at a high radial velocity and therefore with great force. Further, the outer edge of the vane has a high velocity in relation to the fluid in the container positioned outside of the device 20, thereby impacting upon that fluid with great force.

The ratio of the length of each vane to its width, and their placement at the periphery of the plate, creates maximum fluid flow through the cage 21. This is important, for it reduces the total time necessary to mix the fluid in a particular session.

Notably, the hoops, 28, 30 protect the container from damage by the spinning vanes 26. This allows the user to be less careful in positioning the cage 21 in the container 42, as even if the cage 21 encounters the sides or bottom of the container, the cage is unlikely to damage the container.

Another advantage of the mixing device 20 of the present invention is that it mixes the fluid without introducing air into the fluid, as is a common problem associated with other mixers utilized for the same purpose. As can be understood, the introduction of air into a fluid such as paint is extremely detrimental. For example, air within paint will prevent proper operation of many types of paint sprayers and makes uniform coverage when painting difficult. The presence of air is also detrimental, for example, where a polyurethane coating being applied, as air bubbles become trapped in the coating and ruin its appearance.

After the fluid has been adequately mixed, cleaning of the device 20 is fast and easy. A user prepares a container filled with a cleaning agent. For example, in the case of latex paints, water is an effective cleaning agent. The user lowers the cage 21 into the cleaning agent, and turns on the drill 46. The rapid movement of the cleaning agent through the cage 21 causes any remaining original fluid (such as paint) thereon to be cleansed from the device 20.

Once the device 20 is clean, which normally only takes seconds, the device can be left to air dry.

The dimensions of the device 20 described above are preferred when the device is used to mix fluid in a container designed to hold approximately 1 gallon of fluid. When the device 20 is used to mix smaller or larger quantities of fluid of similar viscosity, the device 20 is preferably dimensionally smaller or larger.

While the vanes 26 used in the device 20 are preferably curved, it is possible to use vanes which are flat. The vanes 26 are preferably curved for at least one reason, in that such allows the vanes 26 to have an increased surface area without extending inwardly from the periphery towards the center of the plate 24 beyond the preferred ratio set forth above. Also, it is noted that while the vanes 26 extending from the top and bottom of the plate 24 are preferably oriented in the same direction, they may be oriented in opposite directions (i.e. the convex surfaces of the top and bottom sets of vanes 26 may face opposite directions).

In an alternate version of the invention, vanes only extend from one side of the plate. The vanes may extend from either the top or the bottom side. Such an arrangement is useful when mixing in shallow containers, while retaining the advantages of high fluid flow mixing rates and the straining capability.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A method of mixing fluid comprising:

isolating a fluid to be mixed in a container;

providing a mixing device comprising a support having an outer edge and an axis extending through said support generally perpendicular to said support, a number of vanes extending outwardly from said support generally parallel to said axis, said vanes spacedly located about 0.25 inches apart;

positioning said device in said container containing fluid to be mixed; and rotating said mixing device within said fluid with said container, said vanes straining or dispersing solidified materials in the fluid during said rotating step.

2. The method in accordance with claim 1, wherein said support has a diameter and said providing step further comprising providing said vanes in a number between 4 and 12 per inch diameter of said support.

3. The method in accordance with claim 1, wherein said providing step further comprises providing a hoop connecting a free end of said vanes.

4. The method in accordance with claim 1, wherein said fluid generally comprises a liquid.

5. The method in accordance with claim 4, wherein said liquid comprises paint.

6. The method in accordance with claim 1, wherein said support has a diameter and said providing step further comprises providing said vanes having a length between about 0.1 and 2 times the diameter of said support.

7. The method in accordance with claim 1, wherein vanes extend inwardly of said outer edge of said support no more than about 0.35 of a maximum radial distance from a center of said support to said outer edge thereof.

8. A method of mixing fluid comprising:

isolating a fluid to be mixed in a container;

providing a mixing device comprising a support having an outer edge, a number of vanes extending outwardly from said support and generally defining an open first end of said device;

positioning said device in said container containing fluid to be mixed;

rotating said mixing device within said fluid in said container;

drawing fluid through said open first end defined by said vanes;

expelling said fluid through said vanes; and trapping globules of material in said fluid which do not disperse into said fluid within said device during said rotating step.

9. The method in accordance with claim 8, wherein said vanes are spaced about 0.1–1 inches apart.

10. The method in accordance with claim 8, wherein said support has top side and a bottom side, said vanes defining said open first end extending from said top side, and said providing step further comprising providing vanes extending outwardly from said bottom side of said support generally defining an open second end of said device, and wherein said step of drawing fluid includes the step of drawing fluid downwardly through said open first end and drawing fluid upwardly through said open second end of said device.

11. The method in accordance with claim 8, wherein said support has a diameter and said providing step further comprises providing said vanes extending from said support in a number between 4 and 12 per inch diameter of said support.

12. The method in accordance with claim 8, wherein said providing step further comprises providing a hoop connecting a free end of said vanes.

13. The method in accordance with claim 8, wherein said fluid generally comprises a liquid.

14. The method in accordance with claim 8, wherein said support has a diameter and said providing step comprises providing said vanes have a length between about 0.1 and 2 times the diamter of said support.

15. The method in accordance with claim 8, wherein said vanes extend inwardly of said outer edge of said support no more than about 0.35 of a maximum radial distance from a center of said support to said outer edge thereof.

16. A method of mixing fluid comprising:

isolating a fluid to be mixed in a container;

providing a mixing device comprising a support having an outer edge, a number of vanes extending outwardly from said support, said vanes spacedly located about said support generally in a first direction, said vanes generally defining an open first end of said device;

positioning said device below a top surface of said fluid in said container containing fluid to be mixed;

rotating said mixing device within fluid in said container;

drawing fluid substantially devoid of air downwardly in a direction from said top surface of said fluid through said open first end defined by said vanes; and expelling said fluid outwardly through said vanes, whereby said fluid is mixed without generally introducing air into said fluid.

17. The method in accordance with claim 16, wherein said support has a diameter and said providing step further comprises providing said vanes extending generally in said first direction from said support in a number between 4 and 12 per inch diameter of said support.

18. The method in accordance with claim 16, wherein said providing step further includes the step of providing vanes extending outwardly from said support in a second direction generally opposite said first direction, said vanes extending in said second direction generally defining an open second end of said device, and wherein said step of drawing fluid includes the step of drawing fluid upwardly through said open second end defined by said vanes.

19. The method in accordance with claim 16, wherein said fluid generally comprises a liquid.

20. The method in accordance with claim 16, wherein said vanes extend inwardly of said outer edge of said support no more than about 0.35 of a maximum radial distance from a center of said support to said outer edge thereof.

21. A method of mixing fluid comprising:

isolating a fluid to be mixed in a container;

providing a mixing device comprising a support having an outer edge, a number of vanes extending outwardly from said support generally in a first direction, said vanes spacedly located about said support, said vanes generally defining an open end of said device in communication with an open interior area;

positioning said device in said container containing fluid to be mixed;

rotating said mixing device within said fluid in said container;

drawing fluid into said open interior area through said open end of said device;

expelling said fluid from said open interior area outwardly towards said vanes; and shearing said fluid as it passes through said vanes, whereby globules of material in the fluid are sheared apart and disperse, reducing the size of the globules and integrating the dispersed globules with the remaining fluid, thereby homogenizing said fluid.

22. The method in accordance with claim 21, wherein said support has a diameter and said providing step comprises providing said vanes in a number between about 4 and 12 per inch of diameter of said support.

23. The method in accordance with claim 21, wherein said support has a diameter and said providing step comprises providing said vanes having a length between about 0.1 and 2 times the diameter of said support.

24. The method in accordance with the claim 21, wherein said providing step comprises providing said vanes spaced about 0.1–1 inches apart about said outer edge of said support.

25. The method in accordance with claim 21, wherein said fluid generally comprises a liquid.

26. The method in accordance with claim 21, wherein said vanes extend inwardly of said outer edge of said support no more than about 0.35 of a maximum radial distance from a center of said support to said outer edge thereof.

27. The method in accordance with claim 21, wherein said vanes extend inwardly of said outer edge of said support no more than about 0.25 of said maximum radial distance from a center of said support to said outer edge thereof.

28. A method of mixing a fluid comprising the steps of:

isolating a fluid to be mixed in a container;

providing a mixing structure comprising a support having a top side, a bottom side, a peripheral edge and an axis passing therethrough generally perpendicular to said top and bottom sides, and a number of vanes spaced about said support, said vanes having an outer edge and an inner edge, said inner edge of said vanes extending inwardly towards said axis not more than about 0.35 of the distance from said axis to said outer edge of said vanes, and extending from at least one of said top and bottom sides of said support generally parallel to said axis;

positioning said mixing structure in the container containing fluid; and rotating said structure within said container containing fluid whereby fluid moving through said mixing structure impacts upon the inner edges of said vanes at a high radial velocity to disperse solidified materials in the fluid and the outer edges of the vanes impacts the fluid located outside of said mixing structure at a high velocity to further mix said fluid during said rotating step.

29. The method in accordance with claim 28, wherein said providing step further comprises providing a first hoop joining the free ends of said vanes.

30. The method in accordance with claim 28, wherein said vanes extend inwardly no more than about 0.25 of said distance from said axis to said outer edge of said vanes.

* * * * *

UNITED STATES PATENT AND TRADEMARK OFFICE

CERTIFICATE OF CORRECTION

PATENT NO. : 6,257,753 B1
DATED : July 10, 2001
INVENTOR(S) : David Marshall King; Ronnald Brian King; Thomas Arnold Martin It is certified that error appears in the above-identified patent and that said Letters Patent is hereby corrected as shown below:

Column 2,
Line 52, "Each van" is corrected to read -- Each vane --

Column 4,
Line 5, "it is preferably about 1-14," is corrected to read -- it is preferably about 1-4 --

Signed and Sealed this

Fifth Day of March, 2002

*Attest:*

*Attesting Officer*

JAMES E. ROGAN
*Director of the United States Patent and Trademark Office*